United States Patent [19]

Strauss

[11] 4,217,522

[45] Aug. 12, 1980

[54] MECHANICAL SAFETY SWITCH FOR HIGH INTENSITY DISCHARGE LAMPS

[75] Inventor: Herbert S. Strauss, Paramus, N.J.

[73] Assignee: Duro-Test Corporation, North Bergen, N.J.

[21] Appl. No.: 878,322

[22] Filed: Feb. 16, 1978

[51] Int. Cl.[2] ..... H01J 7/44; H01J 13/46; H01J 19/78; H01K 1/62

[52] U.S. Cl. ..... 315/73; 315/74; 315/47; 315/119; 313/17

[58] Field of Search ..... 315/73, 74, 75, 47, 315/60, 119, 125, 106, 107; 313/17, 227

[56] References Cited

U.S. PATENT DOCUMENTS

| | | | |
|---|---|---|---|
| 4,013,920 | 3/1977 | Petro | 315/107 |
| 4,032,816 | 6/1977 | Rokosz | 315/107 |

*Primary Examiner*—Saxfield Chatmon, Jr.
*Attorney, Agent, or Firm*—Darby & Darby

[57] ABSTRACT

A mechanical safety switch for high intensity discharge lamps designed to open and remove the current from the arc tube to extinguish the discharge when the lamp envelope is broken in which a leaf spring switch arrangement is used comprising two leaf spring members which are in contact along a substantial portion of their lengths to thereby reduce the current carrying requirement per unit area of the leaf springs.

12 Claims, 6 Drawing Figures

MECHANICAL SAFETY SWITCH FOR HIGH INTENSITY DISCHARGE LAMPS

In prior application Ser. No. 577,096, filed May 13, 1975, entitled "High Intensity Discharge Lamp With Integral Means For Arc Extinguishing", which is assigned to the assignee of the subject application, mechanical switch arrangements for high intensity discharge lamp are disclosed. Lamps of this type have an arc discharge tube in which a metal is ionized to produce radiation, including light in the visible range, and an outer envelope which blocks energy in the ultraviolet from being transmitted. The mechanical switch is connected in series with the arc discharge tube so that when the outer lamp envelope breaks, the switch opens and thereby removes the current to the arc discharge tube. This prevents all radiation, including ultraviolet radiation which may be potentially harmful to a viewer if he looks directly at a lamp, from being produced.

In the mechanical switches of the foregoing application, opening of the switch either renders the operating lamp inoperative by interrupting the current supply to an operating arc tube or prevents the arc tube from starting if the envelope is shattered while the lamp is not operating. In one embodiment of the switch of that application, two flexible leaf springs are provided having metallic contacts of a somewhat limited area at their free ends to conduct the relatively high arc tube current when the switch is closed. In general, these contacts are required to carry the arc tube current without arcing or sputtering since this would cause welding of the contacts together. This would render the switch useless since the leaf springs would no longer separate to open the switch when the restraining force of the outer bulb is removed.

While a limited area contact member at the end of each of a pair of leaf springs is an operable configuration, it has several disadvantages. First of all, the use of a pair of contacts provides either a line or point contact only, thereby resulting in a high current carrying capacity per unit of contact area. This introduces the possibility that the contacts might become welded together. Secondly, the relatively small size of the contacts, coupled with the requirement that they be located at the end of the flexible spring members, causes difficulty in aligning the contacts when the outer envelope is placed over the arc tube during the manufacturing operation.

Accordingly, the present invention is directed to an improved switching arrangement for a high intensity discharge lamp which greatly reduces the current carrying requirement per unit area of the switch members by providing a large surface area of engagement and electrical contact for the contact areas of the two leaf springs rather than point or line contacts. In addition, the novel switches of the present invention also simplify assembly and reduce the tendency for misalignment during the lamp sealing operation.

In accordance with the invention, the switch has a pair of leaf springs. One of the leaf springs is electrically connected to the lead-in for the arc tube and the other is connected to a current carrying supply component of the arc tube. The arrangement is such that leaf springs make contact over substantially all of their entire surface areas along a substantial portion of their lengths. The leaf springs are held in a closed condition and restrained by the outer envelope in a manner such that if the outer envelope is broken, the leaf springs will spring apart thereby breaking the current supply to the arc tube.

It is therefore an object of the present invention to provide improved mechanical switches for a high intensity discharge lamp.

A further object is to provide an improved mechanical switch for a high intensity discharge lamp formed by two leaf springs which make contact over substantially their entire surface areas along a substantial portion of their respective lengths.

A further object is to provide an improved switch for a high intensity discharge lamp utilizing two leaf springs which are in contact with each other over a substantial portion of their respective lengths and which are restrained in a closed position by the outer lamp envelope.

Other objects and advantages of the present invention will become more apparent upon reference to the following specification and annexed drawings in which.

Figure 1:
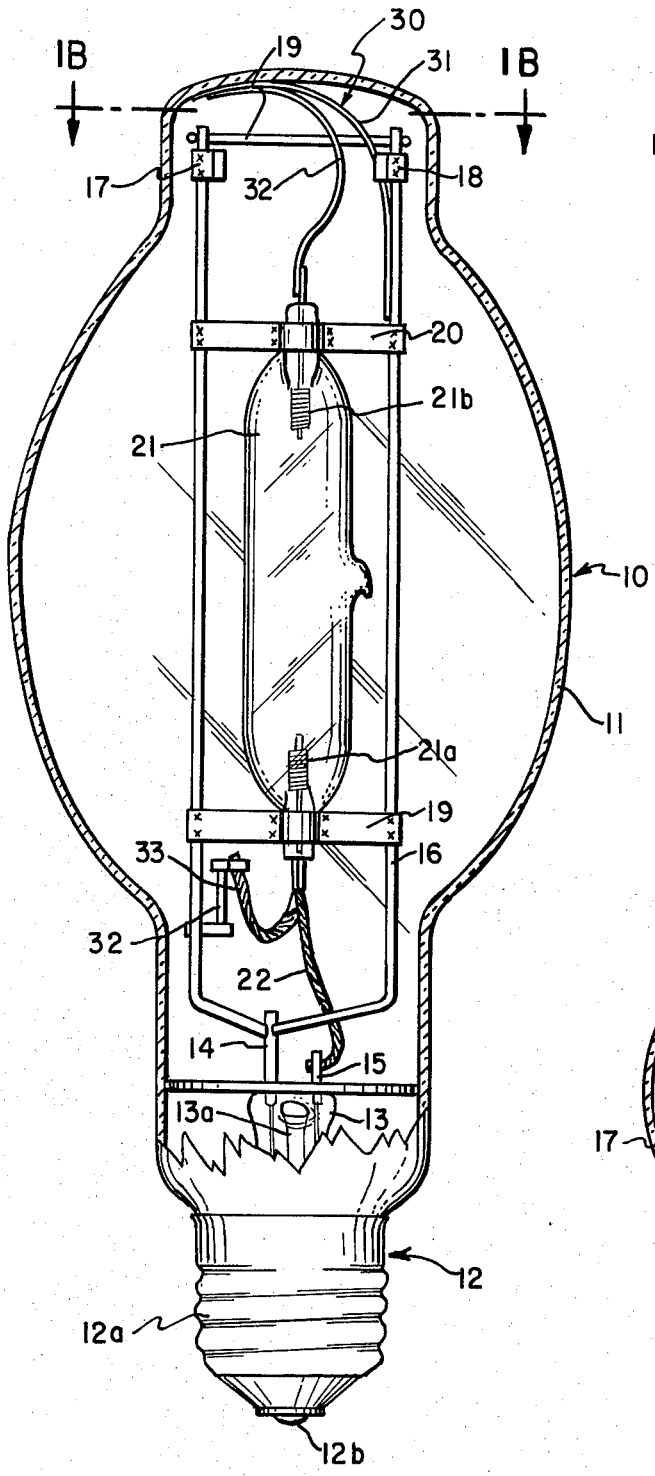
FIG. 1 is an elevational view, partly in cross-section, of a high intensity discharge lamp in accordance with the subject invention and having a preferred embodiment of switch.
Figure 1A:
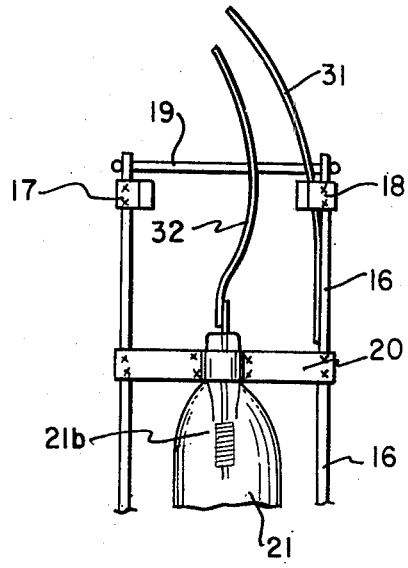
FIG. 1A shows the switch of the lamp of FIG. 1 in the open condition with the outer envelope removed.
Figure 1B:
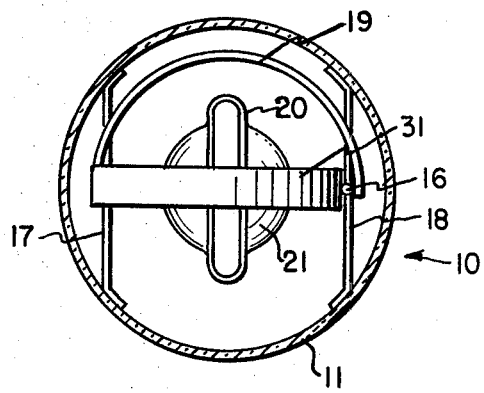
FIG. 1B is a top view of the lamp of FIG. 1 showing the switch closed.

FIGS. 1, 1A and 1B show a typical mercury vapor high intensity discharge lamp 10, for example a 400 watt lamp, incorporating the novel switch for extinguishing the discharge. The lamp 10 includes a generally tubular outer envelope 11 having a bulbous central portion with a conventional base 12 attached to the bottom. Envelope 10 is conventional and made of a material which will transmit light in the visible range and block radiation in the ultraviolet range. Extending inwardly from the base 12 and inside of the envelope 11 is a stem 13 having a tubulation **13*a* and a pair of stiff lead-in wires 14 and 15 in electrical conducting relationship with the respective contact portions 12*a* and 12*b* of base 12**.

Welded to the lead-in wire 14 is a generally rectangular, stiff arc tube mounting frame 16. Two springs 17 and 18 are welded to the vertical wires of frame 16 near its top and a tie bar 19 is welded across the vertical wires of frame 16 to give strength to the completed frame mount within the envelope 11. The springs 17,18 have legs which contact the inner surface of the outer envelope and the upper narrowed down part of the envelope.

Two arc tube supports **20*a* and 20*b* of electrically conductive metal material are welded across the wires of frame 16 and support an arc tube 21, of quartz or other suitable refractory material, at its flattened ends. Arc tube 21 contains the usual main electrodes 21*a* and 21*b* and a starting electrode (not shown). Arc tube 21 contains a discharge medium, mercury in the example being described. Any appropriate medium could be used as is conventional in other types of lamps. The space between the outer envelope 11** and the arc tube is either a vacuum or is filled with an inert gas, for example, nitrogen.

One end of a starting resistor 32 is welded to frame 16. The other end of resistor 32 is connected to the starting electrode by a starting electrode lead wire 33. One lead of a main electrode lead wire 22 of the arc tube 21 is welded to lead-in wire 15 and the other end of wire 22 is connected to and provides a current path to the lower main electrode 21*a*. The other main electrode 21*b* receives its current through a mechanical switch 30, to be described in detail below. With the exception of switch 30, the lamp heretofore described is of conventional construction.

Switch 30 is formed by leaf springs 31,32. One end of leaf spring 31 is attached and electrically connected to, for example by welding, to one of the vertical wires of frame 16 at a point above the arc tube mounting bracket 20*b*. One end of the second leaf spring 32 is attached and directly electrically connected to the lead wire of electrode 21*b* which extends through the arc tube 21. The leaf springs 31 and 32 have substantially the same widths and, if they were straight, they would lie in opposed planes, that is, the surface areas of their flat faces would be facing one or another.

The two leaf springs 31 and 32 are bent in the same direction so that leaf spring 32 lies under leaf spring 31. The two leaf springs are long enough so that the upper surface of leaf spring 31 makes contact with the inner surface of the top of outer envelope 11. The upper surface of spring 32 contacts the lower surface of the spring 31. The surface contact of the leaf springs completes the electrical circuit to the arc tube. The surface contact mating is achieved by the use of flexible, but stiff and resilient leaf spring materials. Both leaf springs 31 and 32 are bent into a part of a loop and restrained from separating by the outer envelope 11.

Should the outer envelope 11 break, usually by some extraneous occurrence, such as an object hitting the envelope, the restraining force of the outer envelope 11 is removed from the leaf springs. The two springs separate and move to a position as shown in FIG. 1A. This breaks the current carrying path to the arc tube and extinguishes the arc.

In the embodiment shown in FIG. 1, the complete surfaces of the two leaf springs 31,32 are in contact with each other for a substantial portions of their respective lengths. In a typical embodiment of 400 watt HID lamp, this would be for a length of about 0.5 inches. The length can be increased or decreased, as needed, within the constraints of the physical limits of the size of the envelope, the distance from the top of the arc tube to the top of the envelope, the bending stress that can be placed on the leaf springs, etc. Typical lengths are from about, for example, 0.35 to 0.65 inches in this embodiment of switch.

The materials for the leaf springs 31 and 32 can be MONEL, or nickel alloys containing nickel, alumium, copper and/or silicon as their constituents with 90–95% nickel the major constituent and about 4% aluminum the next highest. These materials have excellent electrical conductivity and, when properly age-hardened, they remain flexible at the operating temperature of the lamp (about 300° C. near the switch location) and present diffusion bonding across the switch surface contact boundary. The leaf springs can be from about 0.005 inches to about 0.010 inches thick and also about 0.15 to about 0.35 inches wide.

As a typical example, in a 400 watt mercury lamp in which the operating current is approximately 3.2 amperes, the surface contact length 0.5 inches, and the width of the leaf springs 0.25 inches, the current density across the switch area is about 25.6 amperes per square inch. In the case of a contact member such as in the aforesaid prior application, the practical area of contact has only about 0.020 inch diameter or less. This is equivalent to a cross-sectional area of 0.00031 square inches and a consequent current density of 10,323 amperes per square inch across the switch contact "point". Thus, as should be apparent, the larger area of surface contact of switch 30 provides greater distribution of current with a consequent reduction in the possibility of contact welding.

Figure 2:
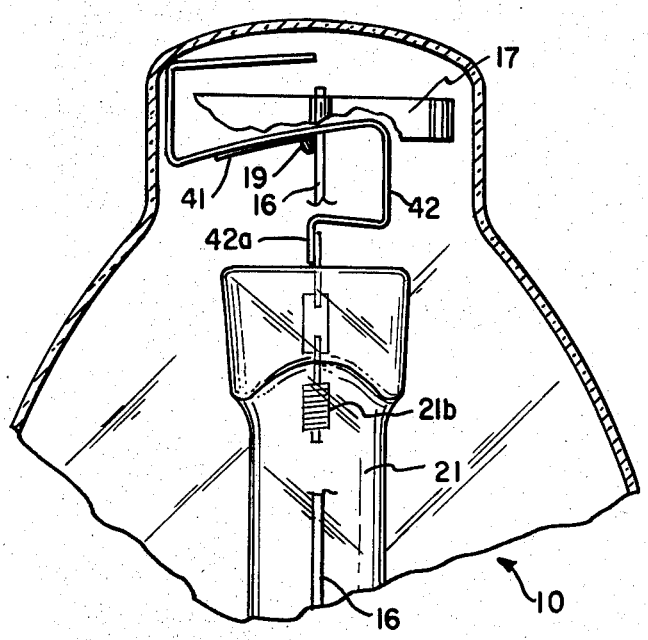
FIG. 2 is an elevational view of a part of a lamp showing a further embodiment of the invention.
Figure 2A:
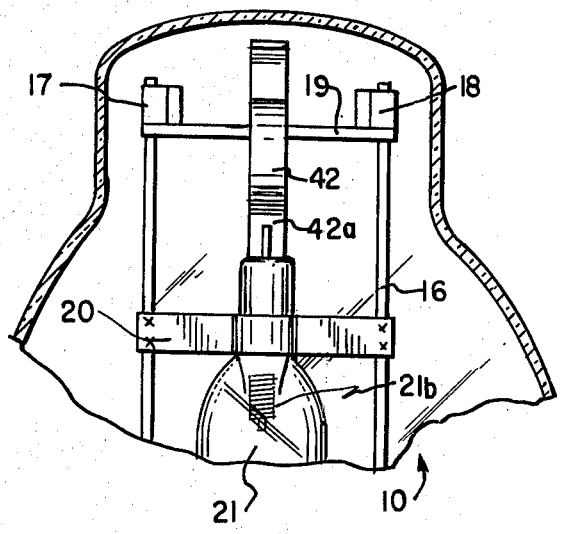
FIG. 2A is a view of the lamp of FIG. 2 turned by ninety degrees to show the switch.

FIGS. 2 and 2A show a further embodiment of the invention. Here, a relatively short leaf spring 41 is welded to the tie bar 19. The second leaf spring 42 is bent into a generally S-shape. The lower horizontal leg of leaf spring 42 has a downwardly bent portion 42*a* which is attached and electrically connected to the lead-in wire of electrode 21*b*. The middle horizontal leg of the spring 42 extends over cross-bar 19 and its lower surface overlies the upper surface of the short leaf spring 41. The two springs 41 and 42 are held in contact by the restraining force of the envelope which contacts spring 42 in the area where the left-hand vertical leg of the S joins the horizontal upper leg.

In the operation of the switch of FIGS. 2 and 2A, if the outer envelope is broken, the restraining force acting on the spring 42 is removed. The central horizontal leg of the S-shaped leaf spring 42 has a high degree of compliance, or springiness. Therefore, when the restraining force is removed, the two springs will move apart and break the electrical circuit to the arc tube. The first leaf spring 41 is preferably made about a half inch long so that electrical contact is provided for at least about 0.25 inches. The length also can be increased or, in some cases, decreased. With the width and thickness dimensions being the same as described with respect to FIG. 1, the amperes per unit area of surface contact is considerably reduced. Here again, the dimensions can be varied.

It should be noted, for example, that if leaf spring 41 were omitted, there would be a line contact across the cross bar 19. This at best, as explained previously, provides a relatively small contact area in which a high amount of current is carried per unit area.

Figure 3:
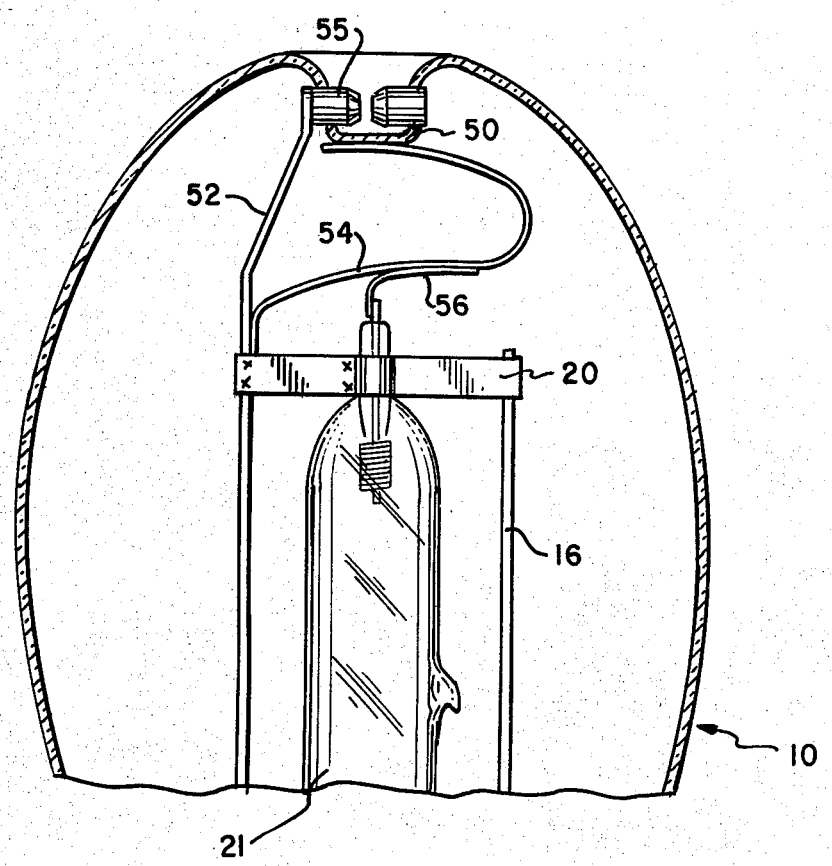
FIG. 3 is an elevational view of a portion of a lamp showing a further embodiment of the invention.

FIG. 3 shows a further embodiment of the invention applied to an E-type outer envelope for a high intensity discharge lamp. This type of lamp differs slightly from the lamps of FIGS. 1 and 2 in the mounting support for the frame 16. Instead of using the mounting springs 17 and 18, the outer lamp envelope is provided with a central downwardly extending neck 50 and the upper left-hand wire of frame 16 has an extension 52. A clip 54 is attached to the top of extension wire 52 and fits around the neck 50.

The switch of FIG. 3 includes a first leaf spring 54 which is attached and electrically connected to the left-hand frame wire above the tie bar 20. The second leaf spring 55 is relatively short and is attached and electrically connected to the lead-in wire for the upper electrode 21*b*.

The upper leaf spring 54 is bent to a generally U-shape, lying on its side, with one leg of the U engaging the bottom surface of the envelope neck 50. The second leaf spring 56 is bent in the same direction as the lower leg of the U of spring 54 so that electrical contact is made along the major portion of the surface of the second leaf spring 56. With the second leaf spring having a length of about 0.5 inches, and the other dimensions as given above, the current carrying capacity per square inch is relatively small, in the order given above. Here also, the various dimensions can be changed.

When the outer envelope of the lamp of FIG. 3 breaks, the restraining force on spring 54 is removed and both springs 54 and 56 will extend generally vertically. Due to the horizontal separation of the points of attachment of the two springs, they will be separated and the current supply to the arc tube will be broken.

What is claimed is:

1. A high intensity discharge lamp comprising:

an outer envelope having lead-ins for supplying electric current passing therethrough, said outer envelope being capable of transmitting light in the visible range and blocking radiation within a predetermined range, an arc discharge tube mounted within said outer envelope, said arc discharge tube including a pair of electrodes sealed therein and a quantity of ionizable material which upon excitation produces light in the visible range and in said predetermined range which passes through said arc tube to said outer envelope, and means for electrically connecting the electrodes of the arc discharge tube to the lead-ins of the outer envelope for supplying electrical current to said arc discharge tube electrodes, said connecting means including a first leaf spring electrically connected to one of said electrodes and a second leaf spring, each of said first and second leaf springs being resilient along its respective length, each of said first and second leaf springs having thereon an electrical contact surface area which is formed by the width of each said leaf spring and a part of the length of each said leaf spring extending in a first direction along the length of the leaf spring which is generally transverse to the width of the respective leaf spring, the length of the respective contact surface area of each of said first and second leaf springs in said first direction being at least as long as the width of the respective leaf springs, means electrically connecting said second leaf spring to one of said lead-ins of said outer envelope, said first and second leaf springs being positioned such that the outer envelope provides a restraining force to deform the leaf springs from a relaxed condition and to hold the electrical contact surface areas of the two leaf springs in a generally aligned and electrically contacting relationship such that physical and electrical contact over their respective electrical contact surface areas is achieved to thereby provide current from said one lead-in to said one electrode, breaking of the envelope causing the restraining force to be removed with the two leaf springs moving apart to remove the current supply to said one electrode.

2. A high intensity discharge lamp as in claim 1 wherein the electrical contact surface areas of said first and second leaf springs in both the width and in said first direction are maintained as opposed generally parallel planes.

3. A high intensity discharge lamp as in claim 1 wherein the width of the electrical contact surface area of both of said leaf springs is in the range of from about 0.15 inches to about 0.35 inches and the length of the electrical contact surface area of both said leaf springs in the first direction is in the range of from about 0.35 to about 0.65 inches.

4. A high intensity discharge lamp as in claim 1 wherein the means electrically connecting said second leaf spring to said one lead-in of said outer envelope comprises a wire electrically connected to said one lead-in and extending within the outer envelope adjacent to said arc tube, said second leaf spring being directly connected to said wire, said first leaf spring being electrically connected to said one electrode, said first and second leaf springs being bent generally in the same direction over the respective electrical contact surface areas of said first and second leaf springs by the restraining force and held in engagement.

5. A high intensity discharge lamp as in claim 4 wherein the outer envelope engages said second leaf spring to provide the restraining force.

6. A high intensity discharge lamp as in claim 5 wherein the first and second leaf springs are elongated and extend generally in the same direction along the major portions of their respective lengths.

7. A high intensity discharge lamp as in claim 6 wherein the free end of the second leaf spring is engaged by the outer envelope, and the free end of the first leaf spring lies under the free end of the second leaf spring.

8. A high intensity discharge lamp comprising:

an outer envelope having lead-ins for supplying electric current passing therethrough, said outer envelope being capable of transmitting light in the visible range and blocking radiation within a predetermined range, an arc discharge tube mounted within said outer envelope, said arc discharge tube including a pair of electrodes sealed therein and a quantity of ionizable material which upon excitation produces light in the visible range and in said predetermined range which passes through said arc tube to said outer envelope, and means for electrically connecting the electrodes of the arc discharge tube to the lead-ins of the outer envelope for supplying electrical current to said arc discharge tube electrodes, said connecting means including a first leaf spring electrically connected to one of said electrodes and a second leaf spring, each of said first and second leaf springs being resilient along its respective length, each of said first and second leaf springs having thereon an electrical contact surface area which is formed by the width of each said leaf spring and a part of the length of each said leaf spring extending in a first direction which is generally transverse to the width of the respective leaf spring, the length of the respective contact surface area of each of said first and second leaf springs in said first direction being at least as long as the width of the respective leaf spring, means electrically connecting said second leaf spring to one of said lead-ins of said outer envelope, said first and second leaf springs being positioned such that the outer envelope engages said second leaf spring to provide a restraining force to deform the leaf springs from a relaxed condition and to hold the electrical contact surface areas of the two leaf springs in a generally aligned and electrically contacting relationship such that physical and electrical contact over the respective electrical contact surface areas of said leaf springs is achieved to thereby provide current from said one lead-in to said one electrode, said first and second leaf springs being bent in the first direction for only a portion of the length of the second leaf spring, the free end of the second leaf spring beyond its electrical contact surface area portion which is in engagement with the electrical contact surface area portion of said first leaf spring being bent in the reverse direction and engaging the inner wall of the outer envelope to provide the restraining force, breaking of the envelope causing the restraining force to be removed with the two leaf springs moving apart to remove the current supply to said one electrode.

9. A high intensity discharge lamp comprising:

an outer envelope having lead-ins for supplying electric current passing therethrough, said outer envelope being capable of transmitting light in the visible range and blocking radiation within a predetermined range, an arc discharge tube mounted within said outer envelope, said arc discharge tube including a pair of electrodes sealed therein and a quantity of ionizable material which upon excitation produces light in the visible range and in said predetermined range which passes through said arc tube to said outer envelope, and means for electrically connecting the electrodes of the arc discharge tube to the lead-ins of the outer envelope for supplying electrical current to said arc discharge tube electrodes, said connecting means including a first leaf spring electrically connected to one of said electrodes and a second leaf spring, each of said first and second leaf springs being resilient along its respective length, each of said first and second leaf springs having thereon an electrical contact surface area which is formed by the width of each said leaf spring and a part of the length of each said leaf spring extending in a first direction which is generally transverse to the width of the respective leaf spring, the length of the respective contact surface area of each of said first and second leaf springs in said first direction being at least as long as the width of the respective leaf spring, a wire located outside of said arc discharge tube to which said second leaf spring is connected for electrically connecting said second leaf spring to one of said lead-ins of said outer envelope, said first leaf spring having a first portion forming the electrical contact surface area and a second portion which is engaged by the inner surface of said outer envelope, said first and second leaf springs being positioned such that the outer envelope provides a restraining force on said second portion of said first leaf spring to deform the leaf springs from a relaxed condition and to hold the electrical contact surface areas of the two leaf springs in a generally aligned and electrically contacting relationship such that physical and electrical contact over their respective electrical contact surface areas is achieved to thereby provide current from said one lead-in to said one electrode, breaking of the envelope causing the restraining force to be removed with the two leaf springs moving apart to remove the current supply to said one electrode.

10. A high intensity discharge lamp as in claim 9 wherein said second leaf spring is generally transverse to the longitudinal axis of the arc tube, said first leaf spring first portion lying over and generally parallel to said second leaf spring and engaging said second leaf spring over its electrical contact surface area.

11. A high intensity discharge lamp as in claim 10 wherein said first leaf spring is generally S-shaped, the lower horizontal leg of the S being connected to said one electrode, said first portion being the central horizontal leg of the S.

12. A high intensity discharge lamp as in claim 11 wherein the second portion of the generally S-shaped first leaf spring which is engaged by the inner surface of said outer envelope is in the area of the junction of the upper horizontal and upper vertical legs of the S.

* * * * *